United States Patent [19]

Winkelmann

[11] 4,439,979

[45] Apr. 3, 1984

[54] DOUBLE TWIST SPINDLE ASSEMBLY

[75] Inventor: Roland Winkelmann, Caluire, France

[73] Assignee: Verdol S. A., Caluire, France

[21] Appl. No.: 372,863

[22] Filed: Apr. 28, 1982

[30] Foreign Application Priority Data

Apr. 30, 1981 [FR] France ..... 81 08833

[51] Int. Cl.[3] ..... D01H 7/86; D01H 13/10; D01H 13/12

[52] U.S. Cl. ..... 57/58.86; 57/58.52; 57/58.83; 57/352; 242/128; 242/147 R

[58] Field of Search ..... 242/128, 147 R; 57/58.49, 58.83, 58.86, 352, 58.52–58.57

[56] References Cited

U.S. PATENT DOCUMENTS

| | | | |
|---|---|---|---|
| 3,018,604 | 1/1962 | Lenk | 57/58.86 X |
| 3,022,623 | 2/1962 | Lenk | 57/58.83 |
| 3,044,246 | 7/1962 | Schippers | 57/58.52 |
| 3,119,224 | 1/1964 | Kocks | 57/58.52 |
| 3,742,693 | 7/1973 | Greive et al. | 57/58.86 |

*Primary Examiner*—John Petrakes
*Attorney, Agent, or Firm*—Dowell & Dowell

[57] ABSTRACT

In a double twist spindle assembly of the type including a central spindle having a bore therethrough and extending through a can, the spindle supporting within the can a lower yarn package and an upper yarn package each feeding yarn into the bore of the spindle above the packages, an improved device for guiding the yarn which is unwinding from the lower package to prevent its contacting the upper package comprising a disk between the packages and a corrolla device supported on the disc to guide the yarn from the lower package away from the upper package, and the corrolla device comprising plural interlaced leaf members which lie against the upper package and follow its shrinking diameter so that the corrolla automatically shrinks in diameter as the yarn is used up.

8 Claims, 7 Drawing Figures

Fig. 5
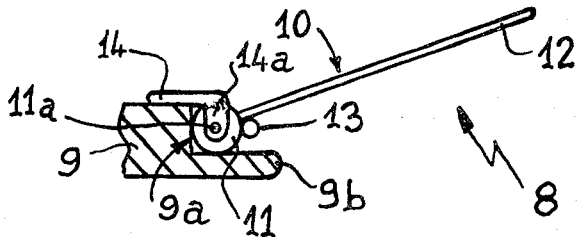
Fig. 6
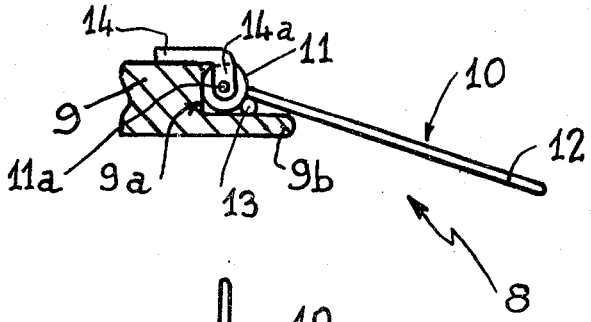
Fig. 7
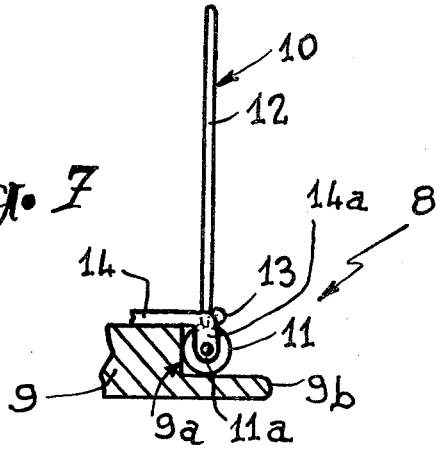
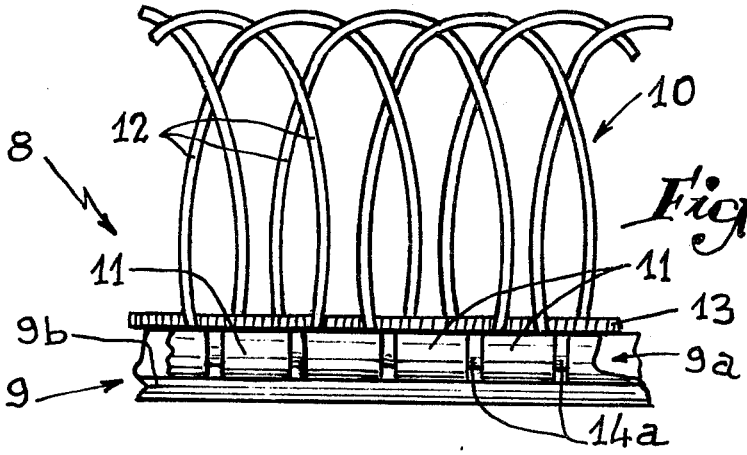
Fig. 4

DOUBLE TWIST SPINDLE ASSEMBLY

It is known that, before the actual twisting of two yarns, they are often brought together just before they are introduced into the central bore of the shaft of the twist spindle. To this end, two packages are disposed one above the other in the can of the spindle and the two yarns are unwound together. However, this arrangement presents difficulties in advancing the yarn from the lower package.

In fact, during unwinding, this yarn rubs on the periphery of the upper package, with the result that it is braked. Consequently, it is not placed parallel to the other yarn with the same tension and, in addition, it tends to wind around the shaft of the spindle by passing beneath the second package, which, of course, leads to breakage thereof.

In any case, assembly of the two yarns is not carried out satisfactorily so that, ultimately, a poorly twisted yarn is obtained.

The general solution consists in placing a disc below the upper yarn package and above the lower one. However, the disc performs its function properly only within the limits of a certain ratio between its outer diameter and the corresponding diameter of the packages.

Moreover, such a disc does not solve another problem raised when it is question of yarns sliding with respect to the packages.

In this case, in fact, the turns of the upper package which are not contacted by the disc risk collapsing and breaking due to the appearance of a phenomenon of winding about the shaft of the spindle. To avoid the passage of the yarn below the disc, the package is generally placed on a sheepskin which does not prevent the turns from collapsing.

German Patent Application DE-No. A628 27 814 discloses a disc whose periphery is provided with elastic leaves. However, the latter can be inwardly only if the tension of the yarn is sufficient. Moreover, the inward deformation of said leaves is not automatically a function of the diameter of the upper package.

In German Patent Application DE-No. A 28 27 853, the periphery of the disc is orientable radially and laterally, but, there again, the inward deformation is caused only by the tension of the yarn; in addition, it is not automatically a function of the diameter of the upper package.

With these two devices, there is a frictional elastic reaction on the yarn which risks provoking wear and even rupture thereof.

The improvements forming the subject matter of the present invention aim at overcoming these drawbacks and at allowing production of a device for guiding the unwinding of the yarn of the lower package by varying the diameter as the diameter of the upper package decreases, independently of the tension of the yarn and without producing frictional action in respect thereto.

The accompanying drawing, given by way of example, will enable the invention to be more readily understood, as well as the features that it presents and the advantages that it may procure:

FIG. 4 is a detailed view thereof to a larger scale.

FIGS. 5 to 7 schematically illustrated the different positions of the device according to the invention.

Figure 1:
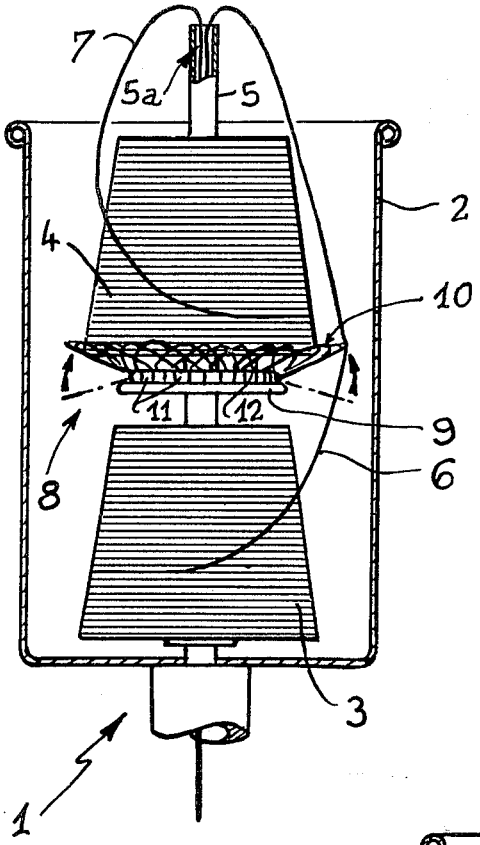
FIG. 1 is an overall view partly in section of a device according to the invention placed inside the can of a twist spindle in which are arranged two superposed packages whose yarns must be brought together before being twisted.

FIG. 1 shows a double twist spindle 1 supporting, in conventional manner, a can 2 in which are disposed, one above the other, two packages 3 and 4 maintained fixed with respect to the shaft 5 of the spindle 1. From the packages, leave two yarns 6, 7 which are brought together in the central bore 5*a* of the shaft 5 so as to be assembled one with the other before twisting. The two inter-twisted yarns are shown at the bottom of the Figure, on leaving the bore 5*a*.

Beneath the upper package 4 is disposd a device according to the invention having the general reference 8 and which cooperates with the periphery of the base of the package 4.

Figure 2:
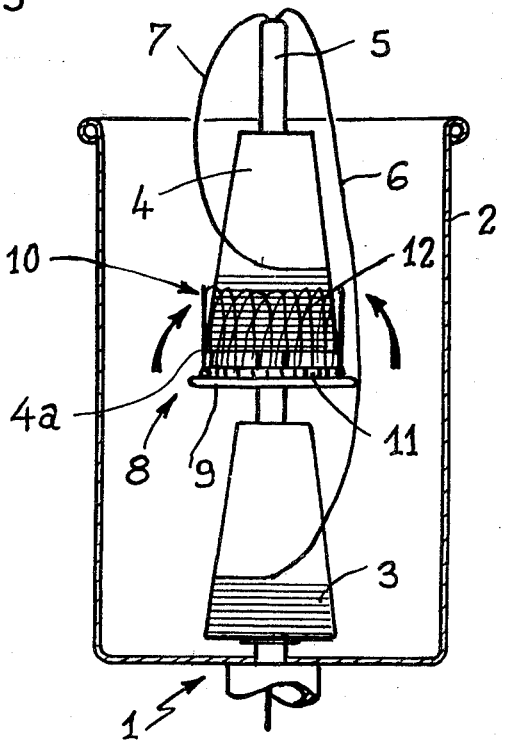
FIG. 2 is a view similar to that of FIG. 1, but showing the packages when they contain virtually no more yarn. The new position of the device according to the invention is illustrated therein.
Figure 3:
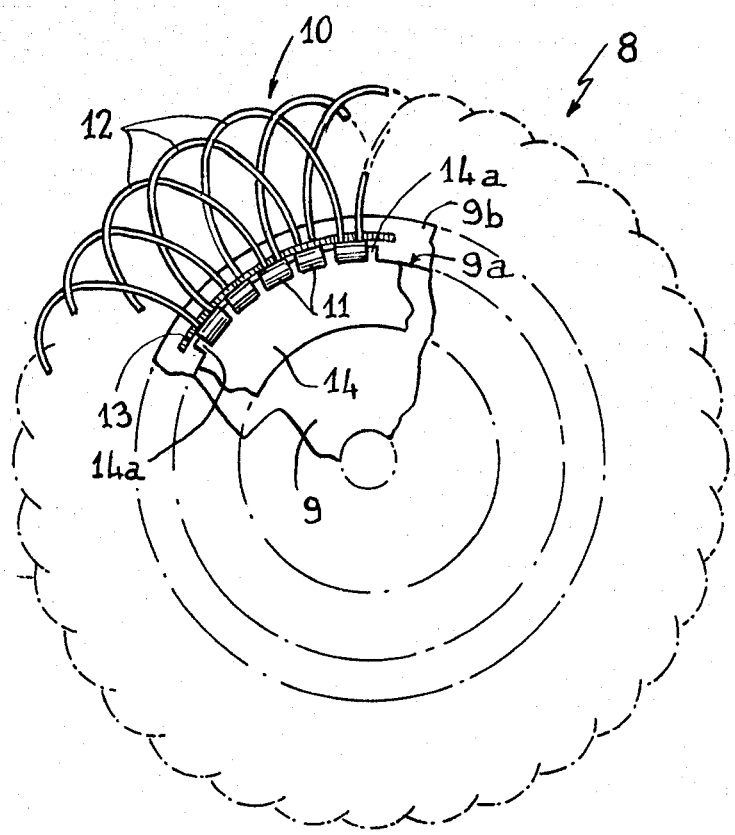
FIG. 3 is a plan view of the device according to the invention, shown in the extended state.

The device 8 has been shown in FIG. 1 in the position which it occupies when the package 4 is full, whilst, in FIG. 2, its position corresponds to the final unwinding of the yarn of the packages.

The device 8 essentially comprises, on the one hand, a disc 9 angularly immobilised with respect to the shaft 5 which is itself stabilised in rotation as is well known in twist spindles, and, on the other hand, a corolla 10. The periphery of the disc 9 comprises an outwardly facing shoulder 9*a* in which is disposed a multiplicity of cylindrical blocks 11 each comprising means for retaining the ends of two hoops 12 which interlace with one another to form the corolla 10. The assembly formed by the blocks 11 is retained in the shoulder 9*a* of the disc by means of a circular elastic ring 13 such as an elastomer, a spring or the like which is interwoven with respect to the hoops 12 as will be more clearly seen in FIG. 4. In fact, the ring 13 passes alternately in front of and behind the ends of the hoops 12 associated with two consecutive blocks 11.

As has been clearly shown, the ring 13 cooperates with the ends of the hoops 12 and the top of the blocks 11.

The hoops may be made by means of strands of resistant plastics material such as nylon or the like and their ends may be engaged in blocks 11 likewise made of plastics material, with respect to which they are welded or otherwise fixed.

As illustrated in FIG. 5, the elastic ring 13 pulls the different blocks 11 against the back of the shoulder 9*a* of the disc 9, this shoulder taking the most appropriate form. With a view to maintaining the blocks 11 against the shoulder 9*a*, they may be provided with central pins 11*a* adapted to engage in holes made in radial lugs 14*a* of a ring 14 associated with the disc 9. The shoulder 9*a* may also be rounded so as better to cooperate with the periphery of the blocks. The latter being defined as pivoting in the shoulder 9*a*, it will be readily understood that the elastic ring 13 urges the corolla 10 in upward direction so that, as illustrated in FIG. 1, it bears against the periphery of the package 4, i.e. against the yarn layer which it supports. As the yarn 7 is unwound from the package 4, the outer layer decreases in diameter and the corolla 10 of the device 8 closes on itself little by little, whilst maintaining contact with its periphery. Thus, the yarn 6 which is unwound from the lower package 3 cooperates with the periphery of the corolla and does not lie against the package 4 so that the resistance to its advance is virtually zero. In this way, the friction on the corolla does not risk producing on the yarn 6 tensions which would be detrimental to correct uniting thereof with the yarn 7 issuing from the upper package 4.

FIGS. 7 and 2 illustrate the position of the corolla 10 when the two packages are virtually empty. It is seen that, at the illustrated moment, the elastic ring 13 causes the corolla 10 to bear against the base 4*a* of the package 4, this corolla then being in virtually vertical position. When it is desired to remove the central core of the package 4 and to load a new full package, it suffices to actuate the corolla so as to bend it downwardly. It then passes through a point of unstable equilibrium to come below the horizontal plane in abutment against the periphery 9*b* of the disc 9, in which position it is stable. Of course, this stable position is rendered possible by the action of the elastic ring 13 on the corolla 10. The top of the disc 9 being completely disengaged, it is very easy to install a package 4 thereon. It goes without saying that the exchange of the package 3 is effected only after dismantling of the device 8 which is returned into position in the can 2 after this operation.

Once the two packages are replaced in the can, the corolla is again deformed manually in upward direction to pass through the point of unstable equilibrium again, so that it comes naturally into elastic abutment against the periphery of the layer of the package 4.

It will be noted that the corolla 10 may be made by any means other than that of hoops 12 associated with blocks 11; by way of non-limiting example, mention may be made of a corolla composed of leaves which open out or retract in the manner of the diaphragm of a camera.

I claim:

1. In a double twist spindle assembly of the type including a central spindle having a bore therethrough and extending through a can and the spindle supporting within the can a lower yarn package and an upper yarn package each feeding yarn into the bore of the spindle above the packages, an improved device for guiding the yarn which is unwinding from the lower package to prevent its contacting the upper package, the improved device comprising:

(a) a disc supported on the spindle radially disposed between the packages;

(b) multiple leaf means pivotally supported on the disc and including outer peripheries extending from the disc and operative to contact the yarn as it unwinds from the lower package and guide it outwardly away from the periphery of the upper package; and (c) the leaf means having means maintaining contact with the outer periphery of the upper package and operative to close the leaf means to decrease the diameter of its periphery independently of the tension of the yarn as the diameter of the outer yarn layer of the upper package decreases.

2. A device as claimed in claim 1, further including elastic means cooperating with said means maintaining contact with the outer periphery of the upper package, said elastic means yieldably urging the leaf means to close inwardly to a smaller diameter.

3. A device as claimed in claim 1, wherein said multiple leaf means comprise hoops pivotally supported around the disc and interlaced to form a corrolla, and elastic ring means engaging the hoops and urging them inwardly to contact the outer periphery of the upper package, the inner peripheries of the hoops comprising said means maintaining contact.

4. A device as claimed in claim 3, wherein the disc supports near its periphery multiple pivotally mounted blocks, and wherein each block supports an end of two different hoops pivotally with respect to the disc.

5. A device as claimed in claim 4, wherein the elastic ring means is interwoven among the hoops and lies against the blocks and is operative to yieldably urge the hoops toward the outer surface of the upper package.

6. A device as claimed in claim 5, wherein the blocks are pivoted to rotate in a horizontal plane and the interwoven elastic ring urges the hoops toward the upper package when the hoops are above said plane and away from the upper package when the hoops are below said plane, the hoops passing through unstable equilibrium when passing through the plane.

7. A device as claimed in claim 6, wherein the disc underlies the blocks supporting the hoops, and the hoops rest against the periphery of the disc when they are below said plane, thereby extending away from the upper package to facilitate changing thereof.

8. A device as claimed in claim 4, wherein the disc has a shoulder therearound displaced inwardly from its periphery, said blocks lying adjacent to the shoulder, and retaining means secured to the disc and rotatably mounting the blocks thereto.

* * * * *